US011378301B2

(12) United States Patent
Zauderer

(10) Patent No.: US 11,378,301 B2
(45) Date of Patent: Jul. 5, 2022

(54) ACCESS PANEL AND DIFFUSER INSTALLATION

(71) Applicant: INVI USA LLC

(72) Inventor: Ron Zauderer, Petah Tikva (IL)

(73) Assignee: INVI USA LLC, Brooklyn, NY (US)

( * ) Notice: Subject to any disclaimer, the term of this patent is extended or adjusted under 35 U.S.C. 154(b) by 0 days.

(21) Appl. No.: 16/611,571

(22) PCT Filed: Jan. 23, 2019

(86) PCT No.: PCT/IB2019/050572

§ 371 (c)(1),
(2) Date: Nov. 7, 2019

(87) PCT Pub. No.: WO2019/145875

PCT Pub. Date: Aug. 1, 2019

(65) Prior Publication Data

US 2020/0096221 A1 Mar. 26, 2020

Related U.S. Application Data

(60) Provisional application No. 62/621,060, filed on Jan. 24, 2018.

(51) Int. Cl.
*F24F 13/06* (2006.01)
*F24F 13/02* (2006.01)

(52) U.S. Cl.
CPC ..... *F24F 13/06* (2013.01); *F24F 13/0245* (2013.01)

(58) Field of Classification Search
CPC ..... F24F 13/02; F24F 13/06; F24F 13/0209; F24F 13/0254; F24F 13/0245
See application file for complete search history.

(56) References Cited

U.S. PATENT DOCUMENTS

| | | | | |
|---|---|---|---|---|
| 2,995,079 | A | 8/1961 | La Fontaine | |
| 3,236,171 | A | 2/1966 | Vaskov | |
| 3,717,081 | A * | 2/1973 | Jakimas | F24F 13/06 454/312 |
| 7,140,960 | B2 * | 11/2006 | Pilger | F24F 13/06 454/331 |
| 7,645,189 | B2 * | 1/2010 | Pilger | F24F 13/0254 454/330 |
| 8,209,921 | B2 * | 7/2012 | Struthers | H02G 1/00 52/204.1 |

(Continued)

FOREIGN PATENT DOCUMENTS

CN 206222635 U 6/2017

OTHER PUBLICATIONS

PCT Search Report PCT/IB2019/050572, dated May 9, 2019.

*Primary Examiner* — Andrew J Triggs

(74) *Attorney, Agent, or Firm* — Dekel Patent Ltd.; David Klein

(57) ABSTRACT

A method includes providing a diffuser that has a frame with a base portion and an outer perimeter portion that protrudes outwards from the base portion. The outer perimeter portion includes a metal flange. A portion of the metal flange is attached to a ceiling stud of a ceiling. The method includes forming an opening in a gypsum board to accommodate the diffuser, and assembling the gypsum board with the ceiling stud so that a bottom surface of the frame of the diffuser is flush with the gypsum board.

7 Claims, 3 Drawing Sheets

(56) References Cited

U.S. PATENT DOCUMENTS

| | | | | |
|---|---|---|---|---|
| 8,245,453 | B2 * | 8/2012 | Struthers | H02G 3/00 52/204.1 |
| 9,705,297 | B1 * | 7/2017 | Nassim | H02G 1/00 |
| 10,001,789 | B2 * | 6/2018 | Hunka | F24F 11/0001 |
| 10,498,122 | B2 * | 12/2019 | Nassim | H02G 3/121 |
| 2003/0177724 | A1 | 9/2003 | Botting | |
| 2004/0067731 | A1 * | 4/2004 | Brinkerhoff | F24F 13/06 454/325 |
| 2004/0185772 | A1 * | 9/2004 | Pilger | F24F 13/02 454/292 |
| 2005/0003754 | A1 * | 1/2005 | Pilger | F24F 13/02 454/292 |
| 2007/0123161 | A1 * | 5/2007 | Pilger | F24F 13/02 454/331 |
| 2009/0191809 | A1 * | 7/2009 | Smith | F04D 29/601 454/354 |
| 2011/0198404 | A1 * | 8/2011 | Dropmann | F24F 13/082 236/49.3 |
| 2013/0043671 | A1 * | 2/2013 | Harman | F24F 13/02 285/3 |
| 2014/0167405 | A1 * | 6/2014 | Lahey | F24F 13/32 285/64 |
| 2019/0069844 | A1 * | 3/2019 | Nassim | H02G 3/121 |
| 2020/0096221 | A1 * | 3/2020 | Zauderer | F24F 13/06 |

* cited by examiner

ACCESS PANEL AND DIFFUSER INSTALLATION

FIELD OF THE INVENTION

The present invention relates generally to installation of ceiling access panels and diffusers, such as those used in air conditioning and air circulating systems.

BACKGROUND OF THE INVENTION

Ceiling air diffusers serve as air inlets for supplying air to a room. The diffuser causes the air to travel radially outwards and substantially horizontally along the ceiling of the room. This keeps the air supplied from the diffuser, which is typically cooled by an air conditioning system, from simply dropping directly downwards from the diffuser. This serves to distribute the air and avoids causing discomfort to any occupants of the room who happen to be directly below the diffuser.

SUMMARY OF THE INVENTION

The present invention relates to methods of installation of ceiling access panels and diffusers, such as those used in air conditioning and air circulating systems, as is described more in detail hereinbelow.

There is provided in accordance with an embodiment of the present invention a method including providing a frame which includes a base portion and an outer perimeter portion that protrudes outwards from the base portion, placing a metal flange placed adjacent the outer perimeter portion of the frame, and locating a portion of the metal flange that protrudes outwards of the outer perimeter portion between a ceiling stud of a ceiling and a gypsum board, forming an opening in a gypsum board to accommodate an access panel or a diffuser, and installing a fastener through the gypsum board and the metal flange into the ceiling stud, thereby attaching the gypsum board to the ceiling stud.

The opening may be formed in the gypsum board either prior to or after fastening the gypsum board to the ceiling stud.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
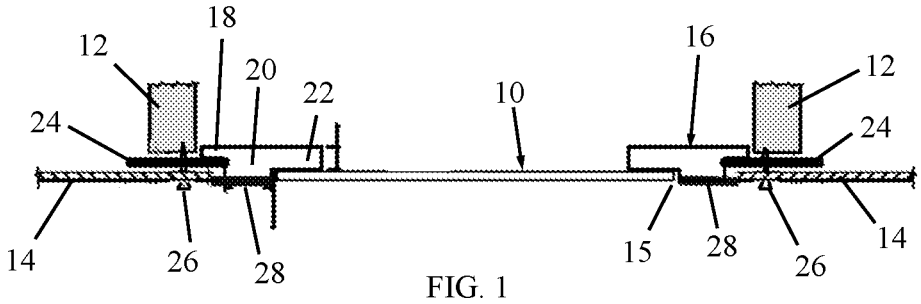
FIG. 1 is a simplified illustration of an installation of an access panel or diffuser in a ceiling, in accordance with an embodiment of the present invention.

Reference is now made to FIG. 1, which illustrates an installation of an access panel or diffuser 10 in a ceiling, constructed and operative in accordance with an embodiment of the present invention.

The ceiling may include ceiling studs 12, typically made of metal. A gypsum board (drop panel) 14 (without limitation, such as ⅝" in thickness) is provided, which will be attached to the ceiling studs (or furring channels or other similar structure) 12.

An opening 15 is cut in the gypsum board 14 to accommodate the access panel or diffuser 10. A frame 16 is provided, which has an inner perimeter portion 18 that overlies the access panel or diffuser 10; a base portion 20, extending from portion 18, whose bottom surface will be flush with the gypsum board 14 after installation; and an outer perimeter portion 22 that protrudes outwards from the base portion 20. A metal flange 24 is placed adjacent (e.g., underneath) the outer perimeter portion 22 of the frame 16, and a portion of metal flange 24 that protrudes outwards of the outer perimeter portion 22 is located between the ceiling stud 12 and the gypsum board 14. The metal flange 24 may be made of sheet metal, aluminum or other metals.

A fastener 26, such as a drywall screw 26, passes through gypsum board 14 and metal flange 24 into each of the ceiling studs 12. Alternatively, the metal flange 24 is first fastened to the ceiling stud with a first set of fasteners (e.g., screws) and then the fasteners 26 are used to fasten the gypsum board 14 into the ceiling stud 12, with the fastener 26 passing through a different place on the metal flange 24. The opening 15 may be formed in the gypsum board 14 either prior to or after fastening the gypsum board 14 to the ceiling studs 12.

After fastening the gypsum board 14 to the ceiling studs 12, joint compound and tape 28 (such as mesh tape) may be applied around the bottom surface all along the perimeter of frame 16, in preparation for painting or other finishing.

Figure 2:
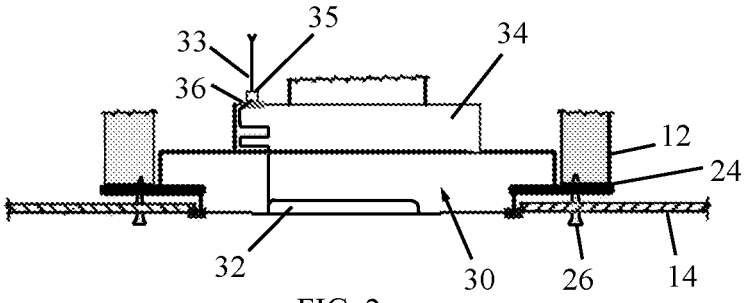
FIG. 2 is a simplified illustration of an installation of a diffuser in a ceiling, in accordance with an embodiment of the present invention.

Reference is now made to FIG. 2, which illustrates an installation of a diffuser 30 in a ceiling, constructed and operative in accordance with an embodiment of the present invention. The installation is similar to the installation described above for the access panel or diffuser 10, with the following differences described below.

The diffuser 30 of FIG. 2 serves as the frame 16 of FIG. 1, except there is no inner perimeter portion 18 of FIG. 1. A light fixture 32 (e.g., an LED light fixture) may be optionally installed in diffuser 30, and may be electrically connected to electrical components disposed in or on a duct takeoff box 34. The electrical components may include, without limitation, wires 33, an LED driver 35, printed circuit boards, etc. The light fixture 32 may be removed to obtain access to the LED driver and an access panel 36 of the box 34.

Reference is now made to FIGS. 3A-3F, which illustrate an installation of a diffuser 40 in a ceiling, in accordance with another embodiment of the present invention.

Figure 3A:
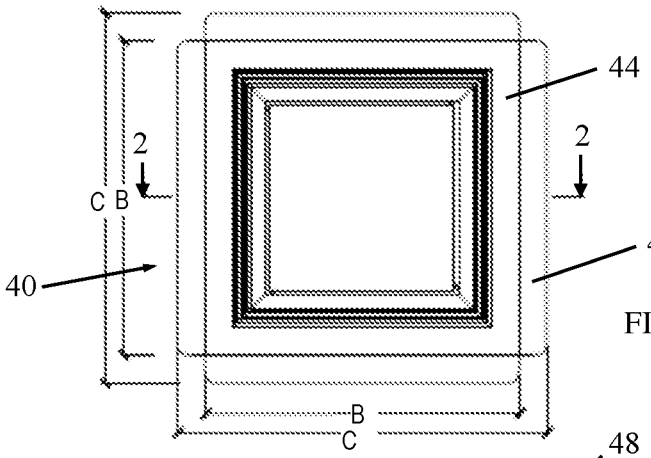
FIGS. 3A-3F are simplified illustrations of an installation of a diffuser in a ceiling, in accordance with another embodiment of the present invention.
Figure 3B:
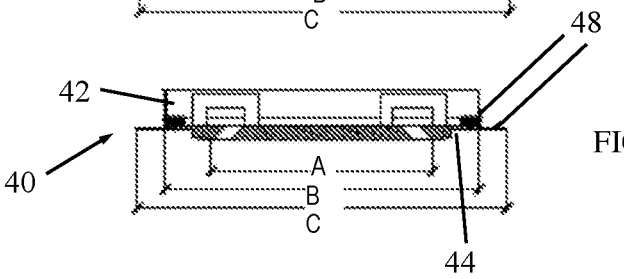

Referring to FIGS. 3A and 3B, diffuser 40 includes a frame 42 and a base portion 44, whose bottom surface will be flush with the gypsum board 14 (shown in FIG. 3F) after installation, as in the other embodiments of the invention. As in the other embodiments, an opening is cut in the gypsum board to accommodate the diffuser. A metal flange 48 is attached to the frame 42. The metal flange 48 may be L-shaped so that one portion (vertical) is attached to frame 42 and another portion (horizontal) serves as the outer perimeter portion of the base portion 44.

Diffuser 40 may be square (although other shapes are contemplated as well) with an outer edge of its opening having a width A (e.g., 12 inches). The frame width may be dimension B (e.g., 17 inches). The border, that is, the flange 48, creates seamless blending into the gypsum ceiling, and may have width C (e.g., 20 inches). The invention is not limited to the above dimensions.

Figure 3C:
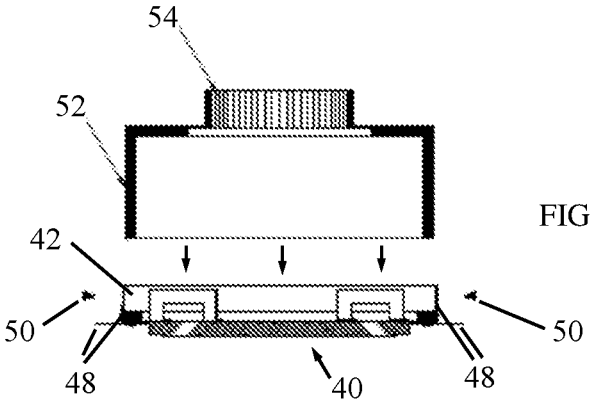

Reference is now made to FIG. 3C. A plenum box 52 may be assembled with diffuser 40. The plenum box 52 may be insulated. The plenum box 52 slides into the vertical flanges 48 and is secured with fasteners 50 to the diffuser frame 42. The height of the plenum box is based on available space, intended air volume, throw, and noise criteria. The plenum box 52 may have a collar 54.

Figure 3D:
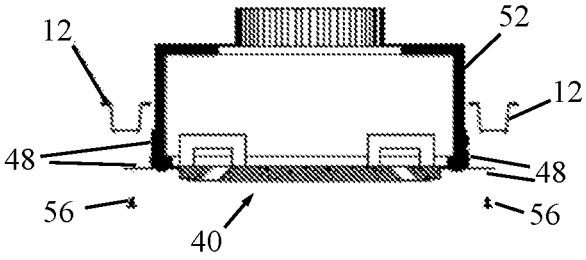

Reference is now made to FIG. 3D. The plenum box 52 and diffuser 40 are attached to the ceiling frame. The entire assembly is held in its intended place and fasteners 56 are screwed through the metal flanges 48 into the furring channel 12 of the ceiling frame. For larger diffuser sizes and certain site conditions, it may be easier to attach the diffuser to the ceiling frame before attaching the plenum box.

Figure 3E:
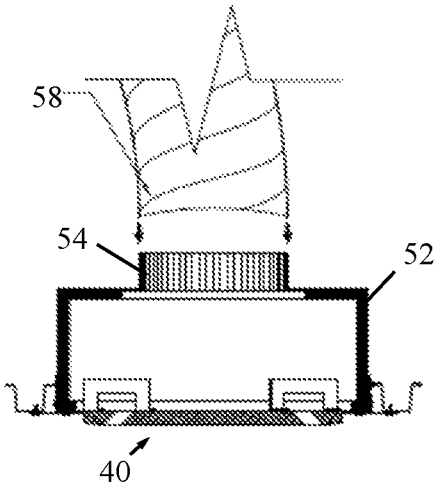

Reference is now made to FIG. 3E, which illustrates the connection of rigid or flexible ductwork 58 to the plenum box 52 before the gypsum board ceiling is in place.

Figure 3F:
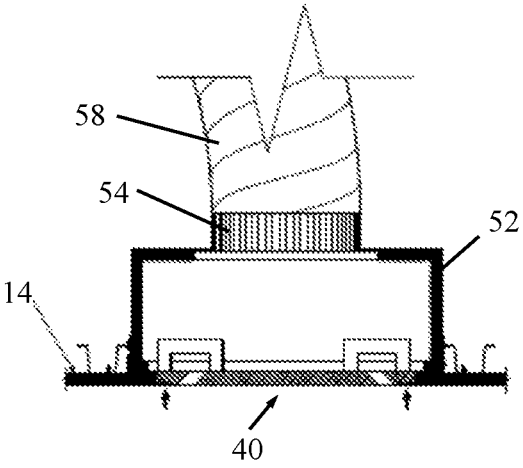

In FIG. 3F, the assembly is affixed to the gypsum board 14 and finish applied as described above. The diffuser 40 creates an edge for receiving normal drywall finishing compound and mesh tape. After proper application and sanding is completed, the diffuser 40 is ready to receive its finish along with the rest of the ceiling.

What is claimed is:

1. A method comprising:

providing a diffuser that has a frame which comprises a base portion and an outer perimeter portion that protrudes outwards from said base portion, said outer perimeter portion comprising a metal flange;

attaching a portion of said metal flange to a ceiling stud of a ceiling;

forming an opening in a gypsum board to accommodate said diffuser; and assembling said gypsum board with said ceiling stud so that a bottom surface of said frame of said diffuser forms a continuous plane with said gypsum board, and applying drywall finishing compound on said bottom surface of said frame of said diffuser and on said gypsum board so that said drywall finishing compound applied to said gypsum board and to said frame of said diffuser forms a continuous plane with said gypsum board and said frame of said diffuser, and said diffuser forms a continuous plane with said gypsum board.

2. The method according to claim 1, wherein the opening is formed in said gypsum board prior to assembling said gypsum board with said ceiling stud.

3. The method according to claim 1, wherein the opening is formed in said gypsum board after assembling said gypsum board with said ceiling stud.

4. The method according to claim 1, wherein said frame has an inner perimeter portion from which said base portion extends.

5. The method according to claim 1, further comprising applying tape around a bottom surface all along a perimeter of said frame.

6. The method according to claim 1, wherein said metal flange is L-shaped so that one portion of said metal flange is attached to said frame and another portion of said metal flange is the outer perimeter portion of said base portion.

7. The method according to claim 1, further comprising assembling a duct to said diffuser, wherein said duct is behind said diffuser and not visible below said diffuser.

* * * * *